United States Patent [19]

Frentress

[11] 4,123,985

[45] Nov. 7, 1978

[54] MEND COUNTER

[75] Inventor: Zane Frentress, Stone Mountain, Ga.

[73] Assignee: Milliken Research Corporation, Spartanburg, S.C.

[21] Appl. No.: 848,810

[22] Filed: Nov. 7, 1977

[51] Int. Cl.[2] ..... D05C 3/00; D05C 15/06

[52] U.S. Cl. ..... 112/266; 112/80

[58] Field of Search ..... 112/266, 80, 79 FF, 112/276, 272

[56] References Cited

U.S. PATENT DOCUMENTS

| | | | |
|---|---|---|---|
| 2,442,906 | 6/1948 | Shay | 112/80 |
| 3,359,931 | 12/1967 | Miller et al. | 112/276 |
| 3,430,590 | 3/1969 | Looper | 112/80 |
| 3,968,758 | 7/1976 | Scholz | 112/80 |

FOREIGN PATENT DOCUMENTS

| | | | |
|---|---|---|---|
| 618,165 | 2/1949 | United Kingdom | 112/80 |

*Primary Examiner*—Ronald Feldbaum

*Attorney, Agent, or Firm*—Earle R. Marden; H. William Petry

[57] ABSTRACT

A mending gun for mending tufted fabric which incorporates a control circuit to count the number of actual mends made but prevents counting of mends of a short duration and ignores mends made more often than a selected adjustable time.

4 Claims, 2 Drawing Figures

MEND COUNTER

An object of the invention is to provide a mending gun for tufted fabric which incorporates a counter which is essentially free from false counts by an operator.

Figure 1:
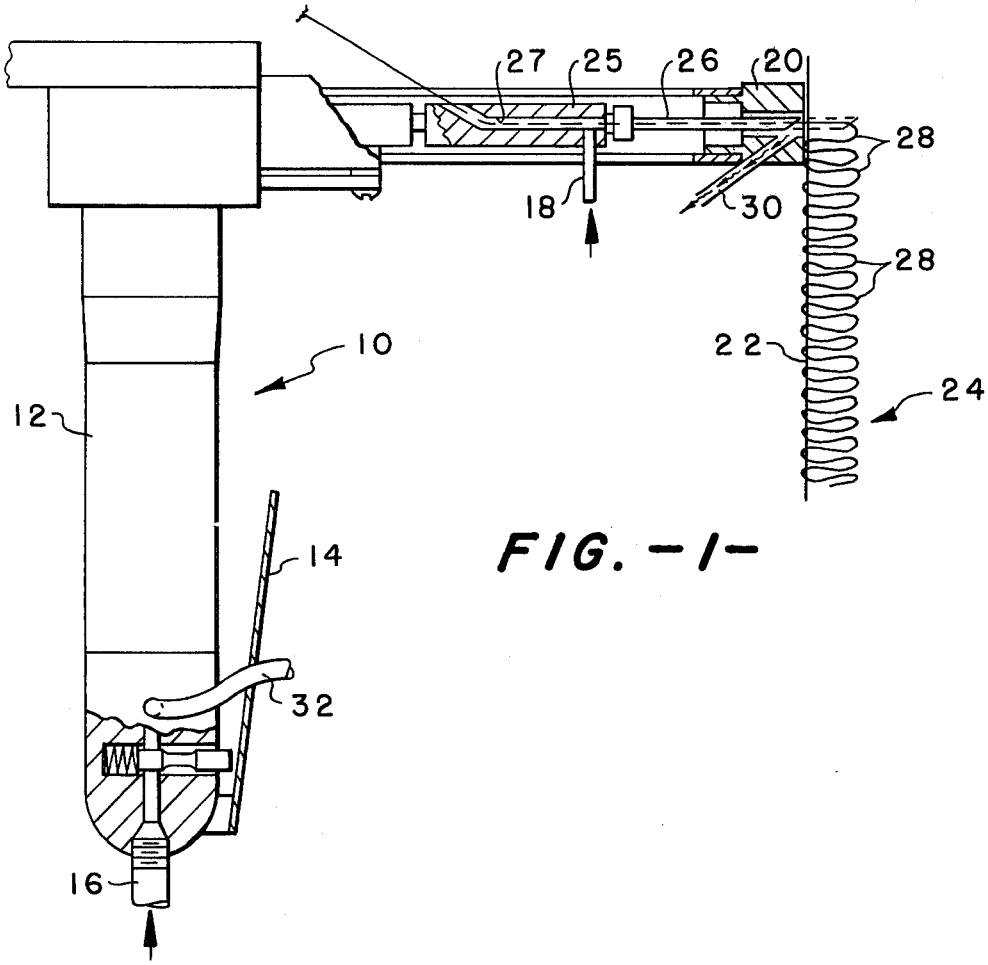
Figure 2:
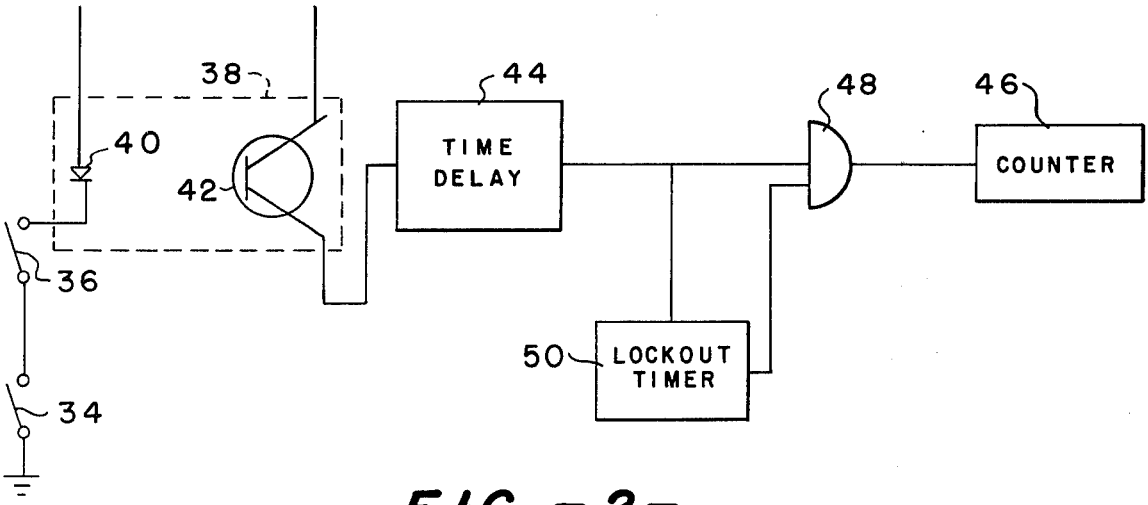

Other objects and advantages of the invention will become readily apparent as the specification proceeds to describe the invention with reference to the accompanying drawings, in which:

FIG. 1 is partially schematic, partially cross-sectional elevation view of the mending gun, and FIG. 2 is a schematic control for the mending gun counter.

In the production of tufted fabrics, some of the tufted yarns may be pulled out during production and must be replaced by an operator before the fabric can be shipped to the customer. To this end, tufted fabric from a tufting machine is run over a vertical stand, behind which stands an operator who will use the mending gun of FIG. 1 to replace any missing tufts of yarn. These operators are paid partially on a basis of how many mends they make during a certain period of time so it is necessary to provide a means to prevent a false count. The mending gun of FIGS. 1 and 2 is designed to accomplish this job with a minimum of false counts being registered on the counter.

Looking now to FIG. 1, the mending gun 10 is basically conventional with several important changes. The gun 10 is a fully air operated mending machine which is actuated by grasping the barrel 12 and squeezing the air control valve lever 14 to supply air from the air inlet 16 to the air motor (not shown) and the air input conduit 18. Normally, the lever 14 will not be actuated until the nozzle 20 of the gun is placed against the backing material 22 of the tufted fabric 24 so that the needle holder 25 preferably will remain retracted to maintain the needle 26 in the retracted position. In operation, a metered amount of yarn is delivered incrementally into the yarn passage 27, so, as the air motor reciprocates the needle holder to move the needle forward to the dotted line position and back to the solid line position, a tufted loop 28 is formed on the opposite side of the backing material 22 by the action of the air from the air input conduit 18 through the hollow tufting needle 26.

MEND SENSING AND COUNTING

In theory, one count could be made for each reciprocation of the needle holder 25 but if the nozzle 20 was not held against the fabric no tufted loop would be formed. To overcome this disadvantage the passage 30 in the nozzle 20 is provided to provide a back pressure in the passage when the nozzle is against the backing material 22 prior to projection of the needle 26 therethrough. This back pressure is employed to provide a pressure signal as hereinafter explained.

Also, rather than have the air input to the conduit 18 dependent on the actuation of the lever 14, the air is supplied continuously, so, for reasons hereinafter explained, a pressure hose 32 is employed to provide a pressure signal whenever the lever 14 is actuated.

Looking now to FIG. 2, the counting cycle will be explained. When the nozzle 20 has been placed against the backing material 22 and the lever 14 actuated the pressure signal from the hose connection 32 will close switch 34 and the pressure signal from passage 30 will close switch 36 so the circuit to the optical coupler 38 will be energized. Switch 36 will remain closed even through the needle, as it alternately penetrates the backing material 22, releases the pressure in passage 30, since the fluctuations of pressure in the passage are filtered by a pressure sensor whose response time is significantly less than the fluctuation rate of the pressure in passage 30. When the switches 34 and 36 are closed, the light emitting diode 40 will be energized to pulse the photo transistor 42 to provide a signal to energize the time delay circuit 44. When the mend has continued for the period of time selected for the time delay circuit 44, the time delay circuit 44 will simultaneously transmit a signal to the counter 46 through the AND gate 48 to count one mend and a signal to the lockout timer 50 will prevent the AND gate from transmitting another count pulse to the counter 46 until the time set on the counter has passed in order to signal mends occurring more often than the selected lockout timer time. When the mend is completed, the lever 14 will be released and mending gun removed from the fabric thereby opening the switches 34 and 36 to set up the current for another mend and mend count.

It can be seen that the improved mending gun for tufted fabric provides a design which allows an accurate count of mends made in a tufted fabric and prevents undue false count.

Although the preferred embodiment of the invention has been described, it is contemplated that many changes may be made without departing from the scope or spirit of the invention and I desire to be limited only by the claims.

I claim:

1. In a mending gun for the mending of tufted fabric which has an air operated, reciprocating hollow needle which projects through a passage in a nozzle, a yarn passage therethrough and a conduit for the introduction of air under pressure, the improvement comprising an air passage adjacent the outlet of the passage in said nozzle which forms a back pressure chamber when said nozzle is placed against a tufted fabric to be mended.

2. A method of mending tufted fabric with an air operated mending gun and accurately counting the number of mends made with said gun, the air operated mending gun having a nozzle with a passage therein, a hollow needle in the passage, means to reciprocate the hollow needle and supply yarn thereto and an air relief passage adjacent the nozzle the improvement comprising the steps of supplying air under pressure to the nozzle, placing the nozzle against a tufted fabric to be mended, sensing the pressure of the air being supplied and the pressure of the air in the air relief passage to actuate a mend counting circuit and supplying a first pulse count to a counter.

3. The method of claim 2 wherein the supply of the pulse count to the counter is delayed a pre-determined length of time.

4. The method of claim 3 wherein further pulse counts are prevented from transmission to the counter for a pre-determined length of time.

* * * * *

UNITED STATES PATENT OFFICE

CERTIFICATE OF CORRECTION

Patent No. 4,123,985 Dated November 7, 1978

Inventor(s) Zane Frentress

It is certified that error appears in the above-identified patent and that said Letters Patent are hereby corrected as shown below:

Column 2, line 5, "through" should read --though--.

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*